US008630566B2

(12) United States Patent
Lee

(10) Patent No.: US 8,630,566 B2
(45) Date of Patent: Jan. 14, 2014

(54) IMAGE FORMING APPARATUS AND DEVELOPER CONTAINER THEREFOR

(71) Applicant: Samsung Electronics Co., Ltd., Suwon-si (KR)

(72) Inventor: Su-in Lee, Seongnam-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/795,400

(22) Filed: Mar. 12, 2013

(65) Prior Publication Data

US 2013/0188994 A1 Jul. 25, 2013

Related U.S. Application Data

(63) Continuation of application No. 13/424,793, filed on Mar. 20, 2012, now Pat. No. 8,422,921, which is a continuation of application No. 12/976,214, filed on Dec. 22, 2010, now Pat. No. 8,165,506, which is a continuation of application No. 12/206,894, filed on Sep. 9, 2008, now Pat. No. 7,881,643.

(30) Foreign Application Priority Data

Mar. 3, 2008 (KR) ..... 10-2008-0019645

(51) Int. Cl.
*G03G 15/04* (2006.01)

(52) U.S. Cl.
USPC ..... 399/119; 399/258; 399/263

(58) Field of Classification Search
USPC ..... 399/119, 258, 263
See application file for complete search history.

(56) References Cited

U.S. PATENT DOCUMENTS

| | | | |
|---|---|---|---|
| 5,589,919 | A | 12/1996 | Ikunami |
| 2001/0021322 | A1 | 9/2001 | Tsuruya |
| 2004/0052538 | A1 | 3/2004 | Yugeta et al. |
| 2005/0041998 | A1 | 2/2005 | Fujii et al. |

(Continued)

FOREIGN PATENT DOCUMENTS

| | | |
|---|---|---|
| CN | 1484110 | 3/2004 |
| CN | 101266438 | 9/2008 |

(Continued)

OTHER PUBLICATIONS

Examination Report issued in European Patent Application No. 08165098.8 on Oct. 5, 2011.

(Continued)

*Primary Examiner* — Walter L Lindsay, Jr.
*Assistant Examiner* — Roy Y Yi
(74) *Attorney, Agent, or Firm* — Stanzione & Kim, LLP

(57) ABSTRACT

An image forming apparatus includes a plurality of developing units respectively including developer inlets, the developing units are arranged side by side in a first direction, a plurality of developer containers to contain developers to be supplied to the plurality of developing units and respectively including developer outlets, the developer units are arranged side by side in the first direction to face the plurality of developing units, and a plurality of developer supplying paths respectively to connect the developer inlets to the developer outlets, wherein the plurality of developer containers include first and second developer containers, and a position of the developer outlet of the second developer container is different from position of the developer outlet of the first developer container.

14 Claims, 8 Drawing Sheets

(56) References Cited

U.S. PATENT DOCUMENTS

| | | | | |
|---|---|---|---|---|
| 2006/0093409 | A1 | 5/2006 | Kyung | |
| 2007/0286646 | A1 | 12/2007 | Ichikawa et al. | |
| 2008/0187357 | A1 | 8/2008 | Miura et al. | |
| 2008/0253804 | A1 | 10/2008 | Furuta et al. | |
| 2012/0177413 | A1* | 7/2012 | Lee | 399/256 |

FOREIGN PATENT DOCUMENTS

| | | |
|---|---|---|
| EP | 1757995 | 2/2007 |
| EP | 1840670 | 10/2007 |
| EP | 1953605 | 8/2008 |
| EP | 2034370 | 3/2009 |
| JP | 2003-167413 | 6/2003 |
| JP | 2005-049490 | 2/2005 |
| JP | 2006-267896 | 10/2006 |
| JP | 2007-148368 | 6/2007 |

OTHER PUBLICATIONS

European Search Report Issued on May 7, 2012 in EP Patent Application No. 12160287.4.

Chinese Office Action Issued on Apr. 27, 2012 in CN Patent Application No. 200810168036.5.

Indian Office Action dated Nov. 29, 2012 issued in IN Application No. 1979/MUM/2008.

European Examination Report dated Mar. 12, 2013 issued in EP Application No. 08165098.8.

* cited by examiner

IMAGE FORMING APPARATUS AND DEVELOPER CONTAINER THEREFOR

CROSS-REFERENCE TO RELATED APPLICATIONS

This is a Continuation Application of U.S. patent application Ser. No. 13/424,793, filed on Mar. 20, 2012, which is a Continuation Application of U.S. patent application Ser. No. 12/976,214, filed Dec. 22, 2010, now U.S. Pat. No. 8,165,506, which is a Continuation Application of U.S. patent application Ser. No. 12/206,894, filed on Sep. 9, 2008, now U.S. Pat. No. 7,881,643 in the U.S. Patent and Trademark Office, which claims priority under 35 U.S.C. §119(a) from Korean Patent Application No. 10-2008-0019645, filed on Mar. 3, 2008, in the Korean Intellectual Property Office, the disclosures of which are incorporated herein in their entirety by reference.

BACKGROUND OF THE INVENTION

1. Field of the Invention

The present general inventive concept relates to an image forming apparatus and a developer container therefore, and more particularly, to an image forming apparatus including a plurality of developing units and a plurality of developer containers.

2. Description of the Related Art

An image forming apparatus, particularly, an electrophotographic color image forming apparatus, includes a plurality of developing units and a plurality of developer containers that supply developers to the developing units. Japanese Patent Laid-open Publication No. hei 2007-148368 relates to an image forming apparatus including developing units for yellow (Y), cyan (C), magenta (M), and black (K) developers and a plurality of developer bottles respectively containing the Y, C, M, and K developers. The developer bottles are arranged from left to right in an order of K, Y, C, and M, and the developing units are arranged from left to right in an order of Y, M, C, and K. In general, the developer bottle that contains the K developer is larger than other developer bottles. That is, the developer bottle for the K developer is longer in vertical or horizontal directions than the other developer bottles. Accordingly, the developer bottles are respectively connected to the developing units through very complicated developer supplying paths. Thus, a size of the image forming apparatus is increased due to this arrangement structure.

SUMMARY OF THE INVENTION

The present general inventive concept provides an image forming apparatus including a plurality of developer containers and a plurality of developing units that are efficiently arranged, and developer containers usable with the image forming apparatus.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing an image forming apparatus including a plurality of developing units respectively including developer inlets, the developing units are arranged side by side in a first direction, a plurality of developer containers to contain developers to be supplied to the plurality of developing units, the developer containers respectively include developer outlets and are arranged side by side in the first direction to respectively face the plurality of developing units, and a plurality of developer supplying paths to connect the developer inlets to the developer outlets, wherein the plurality of developer containers include at least one first and second developer containers and a position of the developer outlet of the second developer container is different from positions of the developer outlet of the first developer container.

The developer inlets may face the developer outlets.

The developer inlets may substantially vertically face the developer outlets.

The plurality of developer containers may include agitators that transfer the developers to the developer outlets, wherein a number of agitators of the second developer container is larger than a number of agitators of each of the first developer container.

Rotation axes of the agitators may be substantially perpendicular to the developer supplying paths.

The plurality of developer supplying paths may not intersect with one another.

The second developer container may have a larger capacity than the first developer containers.

Heights of uppermost portions of the plurality of developer containers perpendicular to the first direction may be equal to one another, and a length of the second developer in the first direction may be longer than a length of each of the first developer container in the first direction.

The first direction may be a vertical direction. Lengths of the plurality of developer containers in the first direction may be equal to one another. A length of the second developer container substantially perpendicular to the first direction may be longer than a length of each of the first developer container perpendicular to the first direction.

The developer outlets may be opposite to the developer inlets so that the developer outlet and the developer inlets are perpendicular to the first direction.

The first direction may be at an angle less than 45° with respect to a horizontal direction, and the developer outlets may be vertically opposite to the developer inlets.

Relative positions of the developer inlets of the plurality of developing units may be substantially the same, and the developer outlets of the first and second developer containers may be determined so that arrangement intervals of the plurality of developing units are substantially the same.

At least one agitator may be arranged at each of both sides of the developer outlet of the second developer container to transfer the developer to the developer outlet.

Agitation directions of the agitators arranged at the both sides of the developer outlet of the second developer container may be opposite to each other.

The second developer container may contain a black color developer, and the first developer container may include three developing containers respectively containing cyan (C), magenta (M), and yellow (Y) color developers.

The foregoing and/or other aspects and utilities of the general inventive concept may also be achieved by providing an image forming apparatus including a plurality of developing units respectively including developer inlets and arranged side by side in a first direction, a plurality of developer containers respectively to contain developers to be supplied to the plurality of developing units, the plurality of developer containers including developer outlets, and at least one agitator to transfer the developers to the developer outlets, the developer containers are arranged side by side in the first direction to face the plurality of developing units, and a plurality of developer supplying paths to connect the developer inlets to the developer outlets, wherein in at least one of the plurality of developing containers, at least one agitator is arranged at each of both sides of the developer outlet.

A capacity of the at least one developer container, in which the at least one agitator each of both sides of the developer outlet is arranged, may be larger than each of capacities of the other developer containers.

Relative positions of the developer inlets of the plurality of developing units may be substantially the same, and the developer outlets of the plurality of developer containers may be determined so that arrangement intervals of the plurality of developing units are substantially the same.

Heights of uppermost portions of the plurality of developer containers perpendicular to the first direction may be equal to each other, and a length of the at least one developer container in the first direction may be longer than a length of each of the other containers in the first direction.

The developer outlets and the developer inlets may be perpendicular to the first direction so that the developer outlets are opposite to the developer inlets.

The first direction may be at an angle less than 45° with respect to a horizontal direction, and the developer outlets may be vertically opposite to the developer inlets.

The plurality of developer supplying paths may not intersect with one another.

The foregoing and/or other aspects and utilities of the general inventive concept may also be achieved by providing a developer container usable with an image forming apparatus to supply a developer to a developing unit, the developer container including a developer outlet to supply the developer to the developing unit, and agitators to transfer the developer toward the developer outlet and respectively arranged at both sides of the developer outlet.

The developer may be a black developer.

A bottom portion of the developer container, which is disposed below the agitator, may have a shape with a curved surface that is convex toward an outside of the developer container.

The foregoing and/or other aspects and utilities of the general inventive concept may also be achieved by providing a developer container apparatus usable with an image forming apparatus respectively including a plurality of developing units arranged side by side in a first direction and including developer inlets and a plurality of developer supplying paths connected to the developer inlets, the developer container apparatus includes first and second developer containers respectively including developer outlets connected to the plurality of developer supplying paths and arranged side by side in the first direction, wherein a position of the developer outlet of the second developer container is different from a position of the developer outlet of the first developer containers.

The respective positions of the developer outlets of the first and second developer containers may be determined so that the developer supplying paths are substantially perpendicular to the first direction.

The foregoing and/or other aspects and utilities of the general inventive concept may also be achieved by providing a developer container usable with an image forming apparatus to supply a developer to a developing unit, the developer container including a developer outlet to supply the developer to the developing unit, and an agitator to transfer the developer toward the developer outlet and disposed at only one side of the developer outlet.

The developer may be a color developer.

A bottom portion of the developer container, which is disposed below the agitator, may have a shape with a curved surface that is convex towards an outside of the developer container.

The foregoing and/or other aspects and utilities of the general inventive concept may also be achieved by providing an image forming apparatus including a plurality of developing units arranged side by side in a first direction, the developing units including developer inlets, a plurality of developer containers arranged side by side in the first direction, and to store developer to be supplied to the plurality of developing units, the developer containers including developer outlets, and a plurality of developer supplying paths to connect the developer inlets to the developer outlets such that the developer inlets and the developer outlets face each other and are substantially perpendicular to the first direction.

The foregoing and/or other aspects and utilities of the general inventive concept may also be achieved by providing an image forming apparatus including first and second developing units, first and second developer containers, and first and second developer supplying paths to connect the first developing unit to the first developer container and to connect to second developing unit to the second developer container, respectively, wherein the first developer container is different from the second developer container and the first developing unit is the same as the second developing unit.

BRIEF DESCRIPTION OF THE DRAWINGS

The above and other features and utilities of the present general inventive concept will become more apparent by describing in detail exemplary embodiments thereof with reference to the attached drawings in which.

DETAILED DESCRIPTION OF THE PREFERRED EMBODIMENTS

Figure 1:
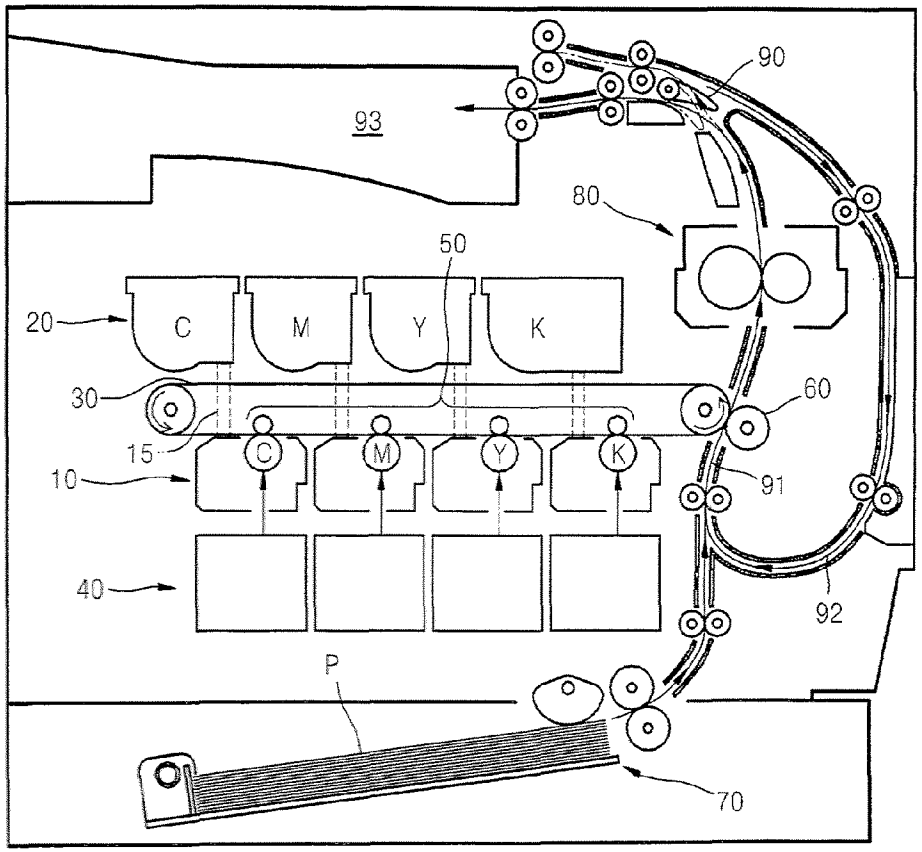
FIG. 1 schematically illustrates an image forming apparatus according to an embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 schematically illustrates an image forming apparatus according to an embodiment of the present general inventive concept. The image forming apparatus of the present embodiment is an electrophotographic color image forming apparatus to print a color image using an electrophotographic method. Referring to FIG. 1, a plurality of developing units 10 and a plurality of developer containers 20 are arranged in a case of the image forming apparatus. The plurality of developing units 10 are arranged in parallel with the plurality of developer containers 20. A plurality of developer supplying paths 15 respectively connect the plurality of developer containers 20 to the plurality of developing units 10. Developers contained in the plurality of developer containers 20 are supplied to the plurality of developing units 20 through the plurality of developer supplying paths 15. The plurality of developer containers 20 and the plurality of developing units 10 may be replaced independently from one another.

Figure 2:
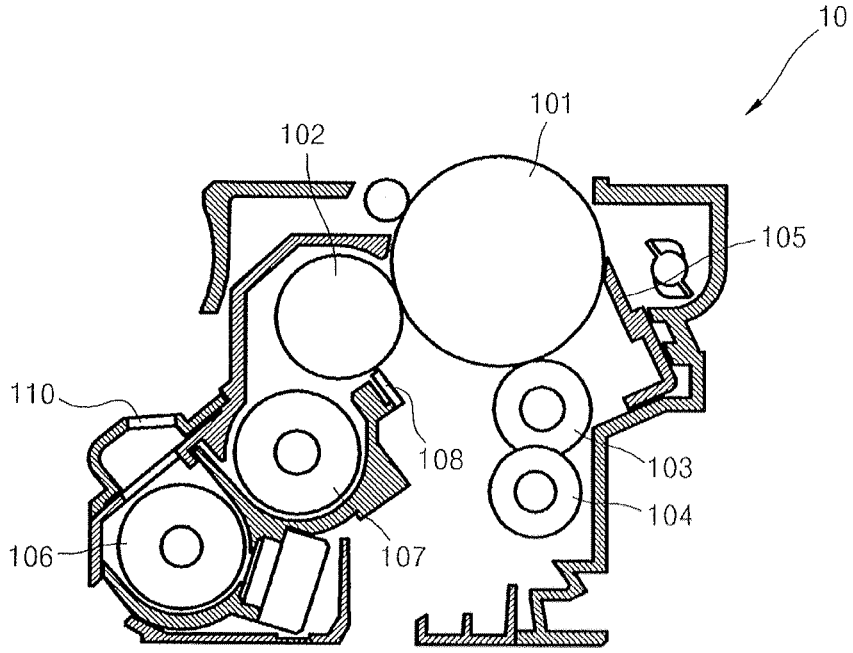
FIG. 2 illustrates a developing unit used in the image forming apparatus of FIG. 1, according to an embodiment of the present general inventive concept.

FIG. 2 is a cross-sectional view illustrating a detailed structure of the developing unit 10 (FIG. 1), according to an embodiment of the present general inventive concept. Referring to FIG. 2, the developing unit 10 includes a photoconductor 101. The photoconductor 101 has a cylindrical shape and a photosensitive layer is formed on a surface of the photoconductor 101. However, the present general inventive concept is not limited thereto. A charging roller 103 charges the photoconductor 101 to a uniform surface potential. A charging brush, a corona charger, or the like may be used instead of the charging roller 103. A charging roller cleaner 104 removes a developer or a foreign substance such as dust or the like that sticks from the surface of the photoconductor 101 to the charging roller 103. A cleaning blade 105 removes the developer remaining on the surface of the photoconductor 101 after an intermediate transfer process that will be described later. A cleaning device such as a brush or the like that rotates may be used instead of the cleaning blade 105. A developing roller 102 supplies the developer contained in the developing unit 10 to the photoconductor 101. A regulator 108 regulates an amount of the developer that is supplied to a developing area in which the photoconductor 101 and the developing roller 102 face each other.

If a two-component type developing method is used, the developing unit 10 contains magnetic carriers. The developing roller 102 remains at a distance of tens through hundreds of microns from the photoconductor 101.

Although not illustrated, the developing roller 102 may be a magnetic roller that is arranged in a developing sleeve. The developer supplied from a developer container 20 to the developing unit 10 sticks to surfaces of the magnetic carriers. The magnetic carriers stick to a surface of the developing roller 102 and are carried to the developing area in which the photoconductor 101 and the developing roller 102 face each other. Only the developer is supplied to the photoconductor 101 due to a developing bias voltage applied between the developing roller 102 and the photoconductor 101 in order to develop an electrostatic latent image formed on the surface of the photoconductor 101 as a visible image.

If a one-component type developing method, wherein carriers are not used, is employed, the developing roller 102 may rotate in contact with the photoconductor 101 or may rotate at a distance of tens through hundreds of micros from the photoconductor 101.

If the two-component type developing method is used, first and second suppliers 106 and 107 mix and agitate the developer flowing in from the developer container 20 (FIG. 1) through a developer inlet 110 with the carriers in the developing unit 10 and then carry the mixed and agitated developer and carriers to the developing roller 102 that is a developing device.

If the one-component type developing method is used, the first and second suppliers 106 and 107 agitate the developer flowing in from the developer container 20 through the developer inlet 110 and then carries the agitated developer to the developing roller 102, that is, the developing device.

The developing method for the image forming apparatus of the embodiment of the present general inventive concept is not limited to the above descriptions, and various changes in form and details may be made thereto.

Referring to FIG. 1, in order to perform color printing, the plurality of developing units 10 may include a plurality of developing units 10C, 10M, 10Y, and 10K to develop cyan (C), magenta (M), yellow (Y), and black (K) color developers. Also, the plurality of developer containers 20 may include a plurality of developer containers 20C, 20M, 20Y, and 20K that respectively contain the C, M, Y, and K color developers that are to be respectively supplied to the plurality of developing units 10C, 10M, 10Y, and 10K. However, the present general inventive concept is not limited thereto. Therefore, developer containers 20 and developing units 10 to contain and develop various color developers such as light magenta, white, etc., may be further included. Hereinafter, an image forming apparatus including the plurality of developing units 10C, 10M, 10Y, and 10K and the plurality of developer containers 20C, 20M, 20Y, and 20K will be described. As long as other specific mentions are not made, reference numerals used in conjunction with C, M, Y, and K denote elements to develop C, M, Y, and K color developers.

Referring to FIGS. 1 and 2, exposing units 40 irradiate light that has been modulated to correspond to image information onto the photoconductors 101 in order to form electrostatic latent images on the photoconductors 101 that will be described later. Representative examples of the exposing units 40 include laser scanning units (LSUs) using laser diodes as light sources, exposing units using light emitting diodes (LEDs) as light sources, etc.

Images formed on the photoconductors 101 of the plurality of developing units 10C, 10M, 10Y, and 10K are temporarily transferred to an intermediate transfer belt 30. A plurality of intermediate transfer rollers 50 are arranged between the intermediate transfer belt 30 and the photoconductors 101 of the plurality of developing units 10C, 10M, 10Y, and 10K so as to contact the photoconductors 101 of the plurality of developing units 10C, 10M, 10Y, and 10K. An intermediate transfer bias voltage is applied to the plurality of intermediate transfer rollers 50 to intermediately transfer the images developed on the photoconductors 101 to the intermediate transfer belt 30. Corona transferring units or pin scorontron type transferring units may be used instead of the intermediate transfer rollers 50.

A transfer roller 60 contacts the intermediate transfer belt 30. A transfer bias voltage is applied to the transfer roller 60 to transfer the images transferred to the intermediate transfer belt 30 to paper sheets P.

Although it has been described in the present embodiment that the images developed on the photoconductors 101 are intermediately transferred to the intermediate transfer belt 30 and then transferred to the paper sheets P passing between the intermediate transfer belt 30 and the transfer roller 60, however, the present general inventive concept is not limited thereto. The paper sheets P may directly pass between the intermediate transfer belt 30 and the photoconductors 101 to directly transfer the developed images to the paper sheets P. In this case, the transfer roller 60 is not included in the image forming apparatus.

A fixing unit 80 applies heat and/or pressure to the images transferred to the paper sheets P to fix and fuse the images onto the paper sheets P. A shape of the fixing unit 80 is not limited to that illustrated in FIG. 1.

According to the above-described structure, the exposing units 40 respectively scan a plurality of laser beams that have been modulated to correspond to image information of respective colors onto the photoconductors 101 of the developing units 10C, 10M, 10Y, and 10K, in order to form electrostatic latent images on the photoconductors 101. The electrostatic latent images on the photoconductors 101 of the plurality of developing units 10C, 10M, 10Y, and 10K are formed as visible images due to the C, M, Y, and K developers that are supplied from the plurality of developer containers 20C, 20M, 20Y, and 20K to the plurality of developing units 10C, 10M, 10Y, and 10K. The developed images are sequentially immediately transferred to the intermediate transfer belt 30. The paper sheets P loaded into a feeding unit 70 are carried through a feeding path 91 between the transfer roller 60 and the intermediate transfer belt 30. The images intermediately transferred to the intermediate transfer belt 30 are transferred to the paper sheets P due to the transfer bias voltage applied to the transfer roller 60. When the paper sheets P completely pass the fixing unit 80, the images are fixed and fused onto the paper sheets P by heat and/or pressure. The paper sheets P that are completely fixed and fused are discharged to a discharging unit 93. If double-sided printing is performed, a selector 90 guides the paper sheets P to a double-sided printing path 92 after images have been formed on front sides of the paper sheets P. Thus, the paper sheets P are re-supplied between the intermediate transfer belt 30 and the transfer roller 60, and other images are transferred to back sides of the paper sheets P. The paper sheets P that have passed the fixing unit 80 are re-discharged to the discharging unit 93 by the selector 90.

Figure 3:
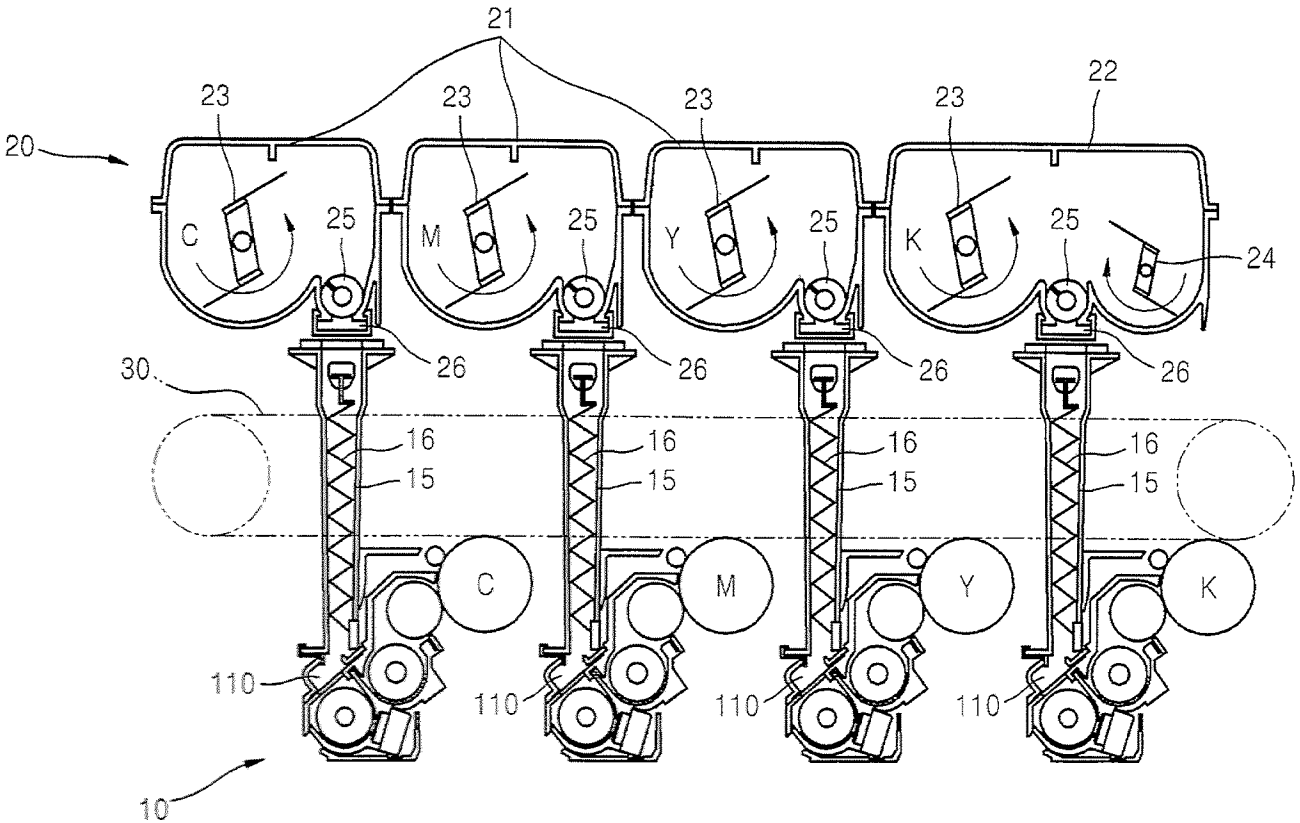
FIG. 3 illustrates a plurality of developing units and a plurality of developer containers that are horizontally arranged in the image forming apparatus of FIG. 1, according to an embodiment of the present general inventive concept.
Figure 4:
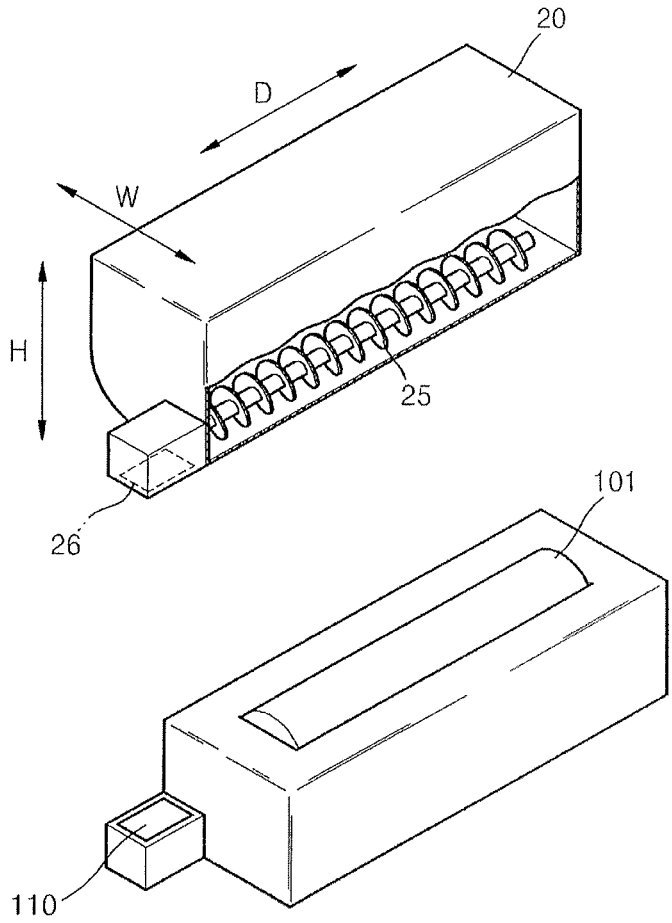
FIG. 4 is a perspective view of a developer outlet and a developer inlet in different positions, according to an embodiment of the present general inventive concept.

FIG. 3 illustrates arrangements of the plurality of developing units 10, the plurality of developer containers 20, and the plurality of developer supplying paths 15, according to an embodiment of the present general inventive concept. FIG. 4 illustrates a relationship between a developer outlet and a developer inlet, according to an embodiment of the present general inventive concept. For convenience, cleaning blades 105, charging rollers 103, and charging roller cleaners 104 arranged at a right of the photoconductors 101 of the developing units 10 are as illustrated in FIG. 2 omitted in FIG. 3. Detailed structures of the developer containers 20 and the developing units 10 are omitted in FIG. 4. Referring to FIGS. 3 and 4, the plurality of developing units 10 are arranged side by side in a first direction, and the plurality of developer containers 20 are arranged side by side in the first direction above the plurality of developing units 10. In the embodiment of FIG. 3, the first direction is the direction of widths W of the developer containers 20, i.e., a horizontal direction. The first direction is also a travelling direction of the intermediate transfer belt 30. The intermediate transfer belt 30 is disposed between the plurality of developing units 10 and the plurality of developer containers 20.

The plurality of developing units 10 respectively include developer inlets 110. The plurality of developer containers 20 respectively include developer outlets 26. The developer supplying paths 15 connect the developer outlets 26 to the developer inlets 110. The developer outlets 26 are provided at ends of the developer containers 20 in a direction of a depth D of the developer containers 20. The developer inlets 110 are provided at ends of the developing units 10 in the direction of the depth D of the developing units 10. A carrying unit 25 is provided in one of the developer containers 20 to transfer the developer in the direction of the depth D of the developer container 20 to the developer outlet 26. For example, an auger may be used as the carrying unit 25.

Lengths L of the developer supplying paths 15 may be, for example, as short as possible. If the lengths L of the developer supplying paths 15 are long, a large amount of power is required to supply the developers to the developing units 10, and the possibility of the developers being congested on the developer supplying paths 15 is increased. If the lengths L of the developer supplying paths 15 are short, and signals that toner is insufficient or does not exist at all in the developing units 10 are generated, the developers may be more rapidly supplied to the developing units 10. If the lengths L of the developer supplying paths 15 are long in a color image forming apparatus requiring several developer supplying paths 15, arranging the developer supplying paths 15 is difficult. For this purpose, the developer inlets 110 may face the developer outlets 26 so that the developer inlets 110 and the developer outlets 26 are perpendicular to the first direction. If the developing units 10 are horizontally substantially parallel with the developer containers 20 as illustrated in FIG. 3, the developer outlets 26 may substantially vertically face the developer inlets 110.

Figure 5:
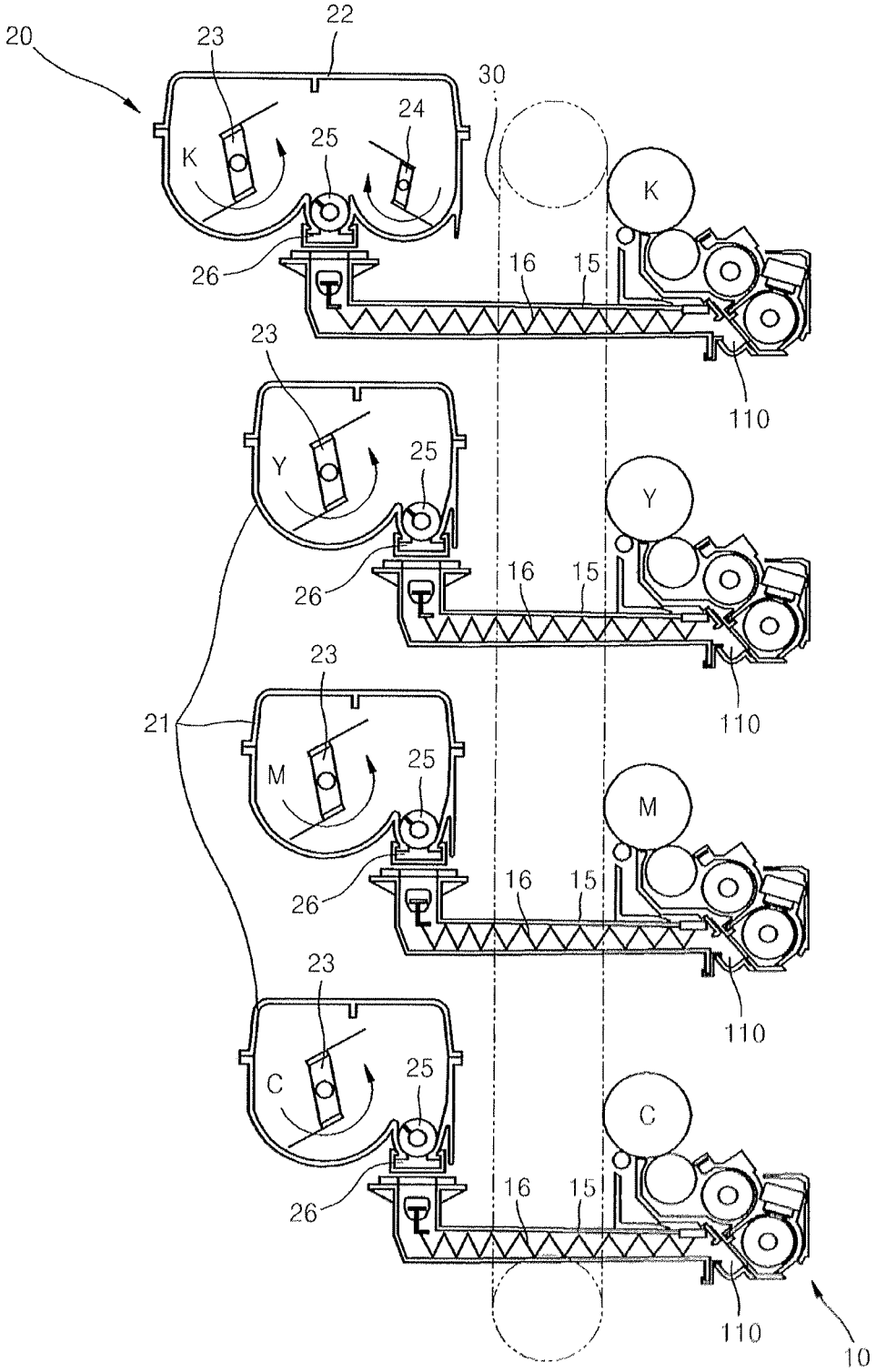
FIG. 5 illustrates a plurality of developing units and a plurality of developer containers that are vertically arranged in the image forming apparatus of FIG. 1, according to an embodiment of the present general inventive concept.

If the developing unit 10 and the developer containers 20 are substantially vertically arranged as illustrated in FIG. 5, the developer outlets 26 may substantially horizontally face the developer inlets 110. In this case, carrying units to carry a developer, e.g., spiral carrier coils (not illustrated) to rotate, augers, or the like, may be disposed in the developer supplying paths 15.

Figure 6:
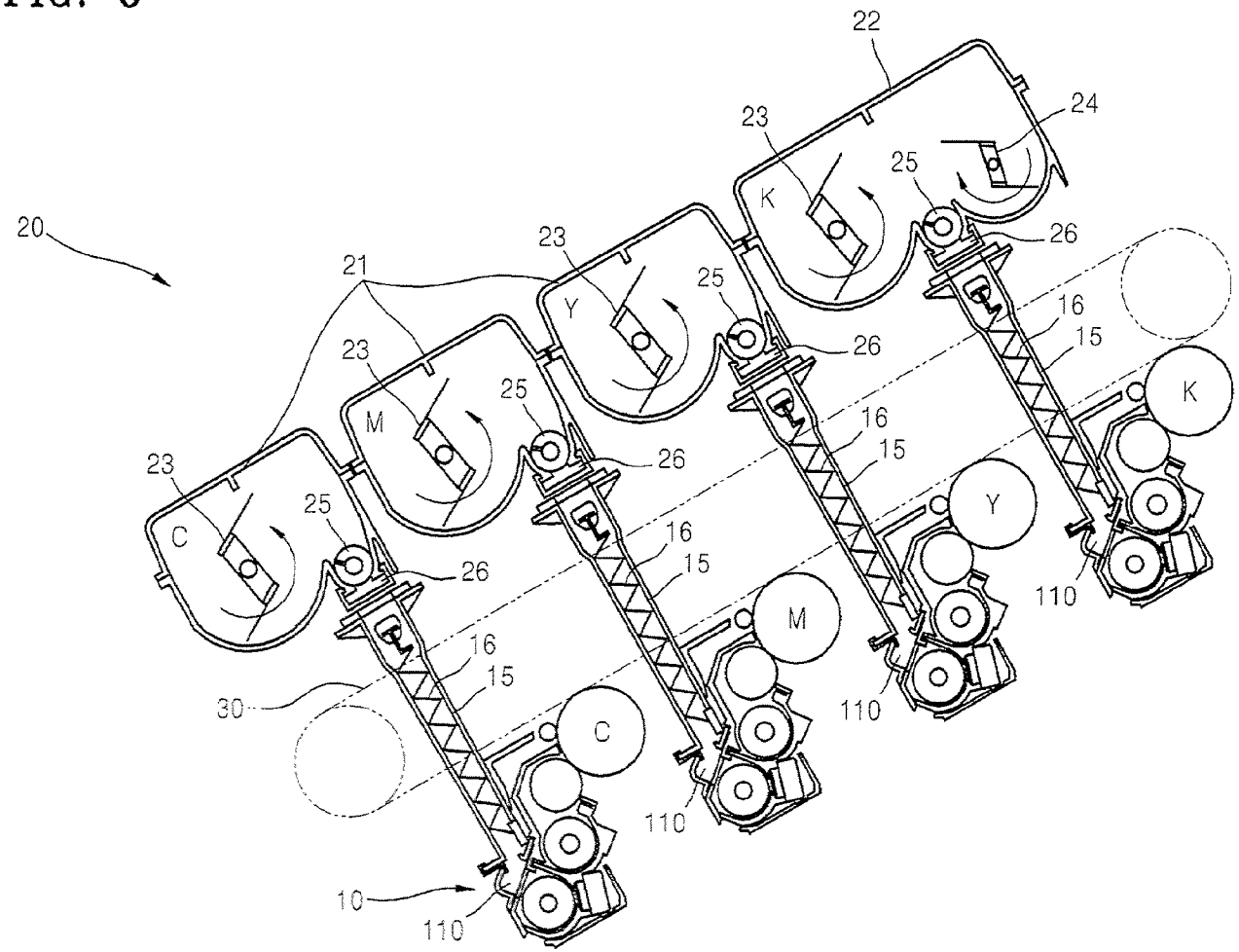
FIG. 6 illustrates a plurality of developing units and a plurality of developer containers that are inclined with respect to a horizontal direction in the image forming apparatus of FIG. 1, according to an embodiment of the present general inventive concept.

The developing units 10 and the developer containers 20 may be inclined toward a horizontal direction as illustrated in FIG. 6. That is, the first direction may form a predetermined angle with the horizontal direction. Even in this case, the developer inlets 110 may face the developer outlets 26 so that the developer inlets 110 and the developer outlets 26 are substantially perpendicular to the first direction, in order to minimize the lengths L of the developer supplying paths 15.

Figure 7:
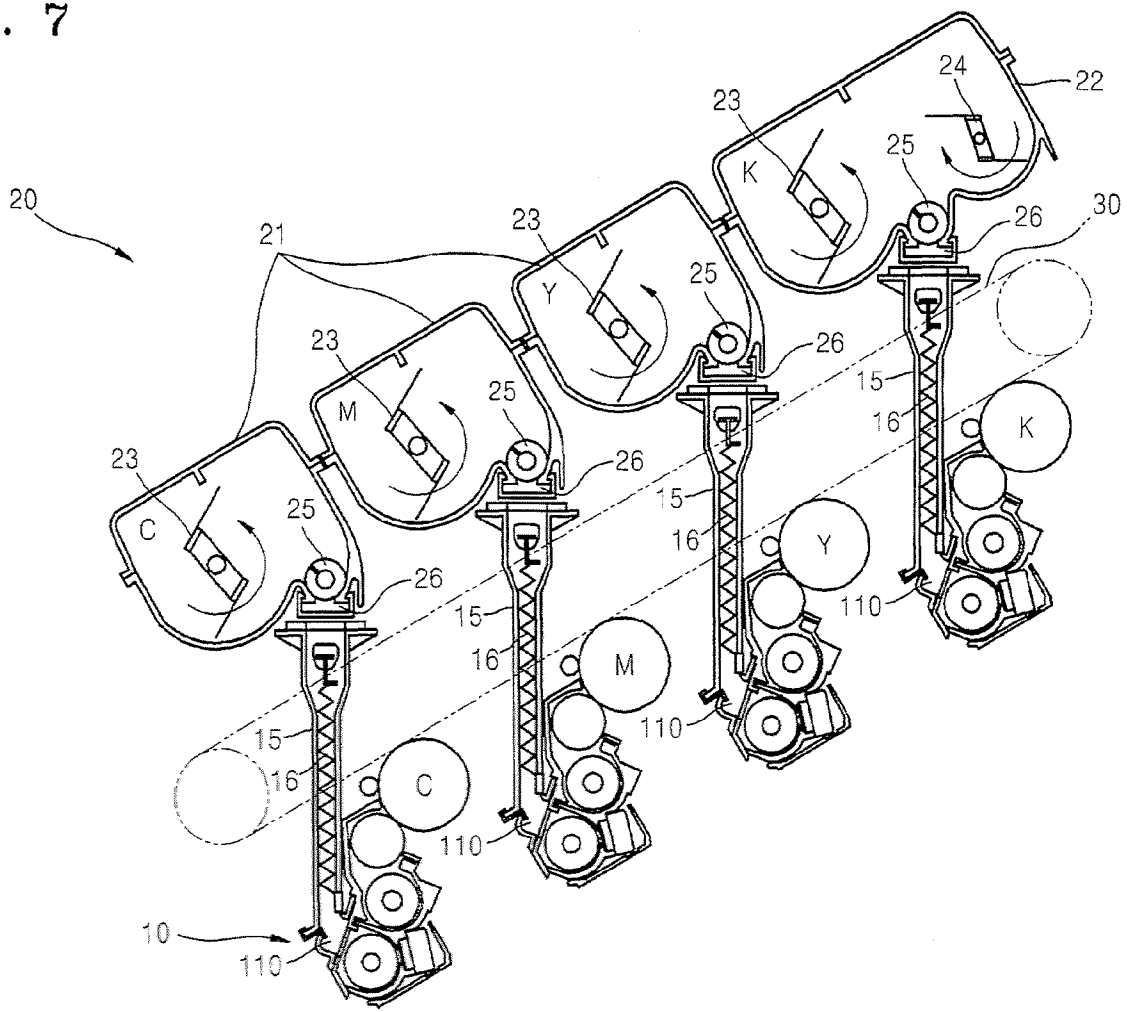
FIG. 7 illustrates a plurality of developing units and a plurality of developer containers that are inclined with respect to a horizontal direction in the image forming apparatus of FIG. 1, according to another embodiment of the present general inventive concept.

Furthermore, the developer supplying paths 15 may be vertically arranged to easily supply the developers to the developing units 10 using gravity. For this purpose, even if the developing units 10 and the developer containers 20 are inclined toward the horizontal direction as illustrated in FIG. 7, and an inclination, i.e., an angle between the first direction and the horizontal direction, does not exceed 45°, the developer outlets 26 may vertically face the developer inlets 110.

The lengths L of the developer supplying paths 15 may be minimized according to the above-described structure. If the developer supplying paths 15 are nearly vertically arranged, the developers may be highly reliably supplied to the developing units 10 without installing additional units in the developer supplying paths 15 to forcingly transfer the developers. In the present embodiment, spiral coils 16 may be added as auxiliary carrying units, which are disposed in the corresponding developer supplying paths 15 to vibrate in longitudinal directions of the developer supplying paths 15, to the developer supplying paths 15 as illustrated in FIG. 3, in order to prevent the developers from being congested and to more highly reliably carry the developers. Also, since the plurality of developer supplying paths 15 do not intersect with one another, the developer supplying paths 15 may be very simply arranged.

A color image forming apparatus may use a larger amount of black color developer than other chromatic color developers. Therefore, the developer container 20K has a larger capacity than the developer containers 20C, 20M, and 20Y. Hereinafter, the developer containers 20C, 20M, and 20Y are referred to as first developer containers 21, and the developer container 20K is referred to as a second developer container 22. The second developer container 22 has a capacity larger than the first developer containers 21. A length of the image forming apparatus toward a direction of a depth D of the image forming apparatus is limited by widths of the paper sheets P used to print. Thus, increasing the depth D of the second developer container 22 is difficult. A width W or a height H of the second developer container 22 may be increased to increase the capacity of the second developer container 22. However, the increase in the height H of the second developer container 22 limits a possibility to decrease the height of the image forming apparatus. As illustrated in FIGS. 3, 6, and 7, heights of uppermost portions of the first and second developer containers 21 and 22 that are perpendicular to the first direction are equal to one another. Also, the length of the second developer container 22 in the first direction, i.e., the width W of the second developer container 22, is different from or longer than lengths of the first developer containers 21 in the first direction. In the embodiment of FIG. 5, the lengths of the first and second developer containers 21 and 22 in the first direction are equal to each other, and the length of the second developer container 22 perpendicular to the first direction is different from or longer than the lengths of the first developer containers 21 perpendicular to the first direction.

Accordingly, the first developer container 21 is different from the second container 22 in structure, size or developer supply operation.

Figure 8:
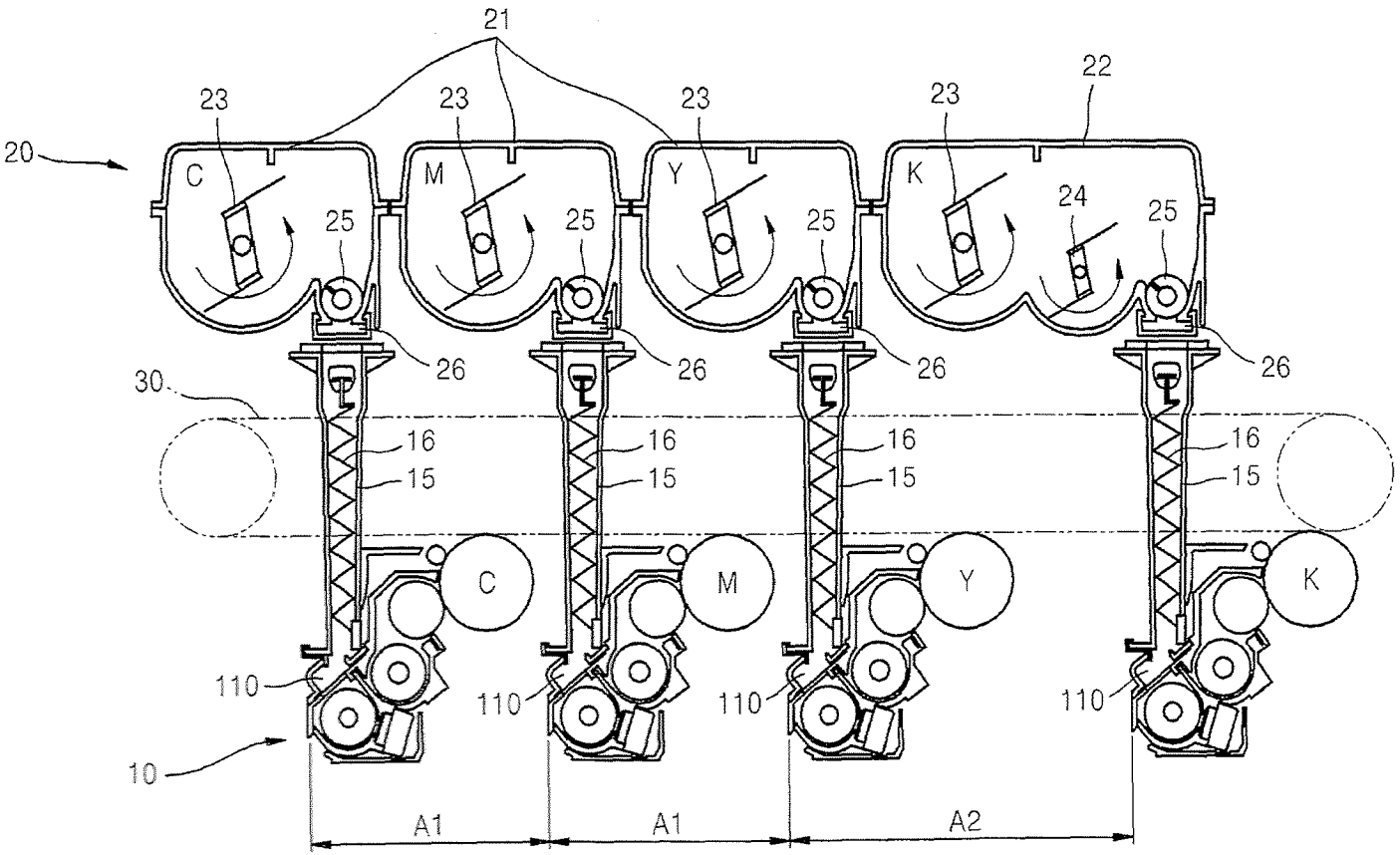
FIG. 8 illustrates an arrangement of agitators of a second developer container, according to an embodiment of the present general inventive concept.

Agitators 23 are disposed in the first developer containers 21 to carry the developers to the developer outlets 26. Two agitators 23 and 24 are disposed in the second developer container 22 to carry the developer to the developer outlet 26. Rotation axes of the agitators 23 and 24 may be perpendicular to a direction of the developer supplying path 15. The developer outlets 26 of the first developer containers 21 may be disposed near an end of the first developer containers 21 in width W of the first developer containers 21. Also, the first developer containers 21 may carry the developers to the developer outlets 26 using only the agitators 23. The width W of the second developer container 22 may be long. Thus, if the developer outlet 26 of the second developer container 22 is disposed near an end of the second developer container 22 toward the width W of the second developer container 22, as illustrated in FIG. 8, the second developer container 22 may use the two agitators 23 and 24 or more to carry the developer positioned at an other end of the developer container 22 to the developer outlet 26. In this case, when the developer is carried by the two agitators 23 and 24, stress is applied to the developer due to friction between the agitators 23 and 24 and an inner wall of the second developer container 22, or the like. An additive is separated from the developer due to the stress, and thus a function of the developer is deteriorated. As a result, a printing quality may be worsened. Therefore, in the present embodiment, the agitators 23 and 24 are respectively arranged at both sides of the developer outlet 26 as illustrated in FIGS. 3, 5, 6 and 7. In this case, rotation directions of the agitators 23 and 24 may be opposite to each other. In the present embodiment, the rotation direction of the agitator 23 is counterclockwise, and the rotation direction of the agitator 24 is clockwise. According to this structure, a carried distance of the developer is shortened, and a friction time when the agitators 23 and 24 contact an inner wall of the second developer container 22 is reduced. Thus, the stress on the developer may be reduced. It has been described in the above-described embodiment that each of the first developer containers 21 includes one agitator 23, and the second developer container 22 includes the two agitators 23 and 24. However, the present general inventive concept is not limited thereto. Since the width W of the second developer container 22 is wider than the widths W of the first developer containers 21, the second developer container 22 requires a larger number of agitators than the first developer containers 21. However, each of the first developer containers 21 may include two or more agitators, and the second developer container 22 may include three or more agitators.

Moreover, positions of the developer outlets 26 of the first and second developer containers 21 and 22 may be determined so that the plurality of developing units 10 are arranged at equal intervals. The width W of the second developer container 22 is wider than the widths W of the first developer containers 21. If the developer outlet 26 of the second developer container 22 is disposed adjacent to an end of the second developer container 22 in the first direction like the first developer containers 21, an arrangement interval A2 of the developing unit 10K corresponding to the second developer container 22 is larger than each of arrangement intervals A1 of the developing units 10C, 10M, and 10Y corresponding to the first developer containers 21 as illustrated in FIG. 8. In this case, spaces occupied by the developing units 10C, 10M, 10Y, and 10K are increased. Thus, an entire size of the image forming apparatus is increased. However, the developer outlet 26 of the second developer container 22 may be disposed so that the arrangement interval A2 is equal to each of the arrangement intervals A1, in order to minimize the spaces occupied by the developing units 10C, 10M, 10Y, and 10K. Also, in the color image forming apparatus of the present general inventive concept, developing starting times of the developing units 10C, 10M, 10Y, and 10K must be sequentially controlled in consideration of intervals among the developing units 10C, 10M, 10Y, and 10K. If arrangement intervals of the developing units 10C, 10M, 10Y, and 10K are equal to one another, the developing starting times of the developing units 10C, 10M, 10Y, and 10K may be more easily controlled.

Since the plurality of developing units 10 perform the same functions, sizes or portions of the plurality of developing units 10 may be the same. According to the above-described structure, positions of the developer inlets 110 of the plurality of developing units 10 may be the same. Thus, the plurality of developing units 10 may use the same types of frames, developing rollers, or the like. As a result, when the plurality of developing units 10 are manufactured, the quality of the plurality of developing units 10 may be managed according to the same standard.

If the capacity of the second developer container 22 is larger than the capacities of the first developer containers 21, the second developer container 22 may be arranged in an outermost position in the first direction.

It has been described in the above embodiment that if the width W of the second developer container 22 is wider than the widths W of the first developer containers 21, the position of the developer outlet 26 of the second developer container 22 is relatively different from the positions of the developer outlets 26 of the first developer containers 21. However, the present general inventive concept is not limited thereto. The present general inventive concept illustrates that a position of a developer outlet of at least one (a second developer container) of a plurality of developer containers is relatively different from positions of developer outlets of the other developer containers (first developer containers). Also, in the present embodiment, agitators are arranged at both sides of the developer outlet of the at least one developer container (the second developer container) of the plurality of developer containers. Therefore, it will be understood by those of ordinary skill in the art that if the widths W of the first and second developer containers 21 and 22 are equal to one another, the position of the developer outlet 26 of the second developer container 22 may be different from the positions of the developer outlets 26 of the first developer containers 21 or agitators may be arranged beside both sides of the developer outlet 26 of the second developer container 22.

As described above, in an image forming apparatus and developer containers according to the present embodiment, distances between developer outlets and developer inlets are minimized to shorten lengths of a plurality of developer supplying paths and efficiently arrange the plurality of developer supplying paths. Also, developing units and developer containers are effectively arranged to optimize a size of the image forming apparatus. In addition, stress applied to developers contained in the developer containers and stress applied to the developers that are supplied from the developer containers to the developing units are reduced. Moreover, the plurality of developing units include the same types of elements to simply manage a quality of the developing units during manufacture thereof. Furthermore, arrangement intervals of the plurality of developing units are equal to one another to easily control the plurality of developing units in a color image forming apparatus.

While the present general inventive concept has been particularly illustrated and described with reference to exemplary embodiments thereof, it will be understood by those of ordinary skill in the art that various changes in form and details may be made therein without departing from the spirit and scope of the present general inventive concept as defined by the following claims.

What is claimed is:

1. A color image forming apparatus for printing a color image on a printing medium, the color image forming apparatus comprising:

a plurality of developing units respectively including developer inlets and arranged side by side in a first direction;

a plurality of first developer containers respectively to contain non-black color developers to be supplied to the respective developing units, each of the plurality of first developer containers including a developer outlet for discharging developer and at least one agitator rotatably installed therein;

a second developer container having a first housing section and a second housing section to contain black color developer to be supplied to one of the developing units, the second developer container including a developer outlet for discharging developer, a first agitator mounted in the first housing section to rotate with respect to a first rotational axis in a depth direction of the second developer container and a second agitator to rotate with respect to a second rotational axis parallel to the first rotational axis; and a plurality of developer supplying paths provided between the developer inlets of the developing units to the developer outlets of the respective developer containers, wherein the first developer containers and the second developer container are arranged side by side in the first direction corresponding to the respective developing units, wherein the developer outlet of the second developer container is provided at an end region of the second developer container in the depth direction, wherein the first agitator and the second agitator of the second developer container are disposed in opposite sides of the second developer container in relation to the developer outlet and wherein the developer inlets of the developing units vertically face the developer outlets of the respective developer containers.

2. The image forming apparatus of claim 1, wherein the developer outlet of the second developer container is provided at a lower region thereof between the first and second agitators.

3. The image forming apparatus of claim 2, wherein the second developer container further comprises an auger to transfer developer in the depth direction to the developer outlet.

4. The image forming apparatus of claim 3, wherein the first and second agitators transfer the developer in a direction toward the auger.

5. The image forming apparatus of claim 4, wherein the first agitator and the second agitator of the second developer container are adapted for rotation in opposite rotational directions with respect to each other to transfer the developer toward the auger.

6. The image forming apparatus of claim 1, wherein the plurality of first developer containers includes three developing containers respectively containing cyan (C), magenta (M), and yellow (Y) color developers.

7. The image forming apparatus of claim 1, wherein the second developer container has a larger capacity than the first developer containers.

8. The image forming apparatus of claim 1, wherein each of the developing units includes a photoconductor, a charging roller to charge the photoconductor and a developing roller to supply developer to the photoconductor.

9. A developer container containing developer to be supplied to a developing unit and mountable in an image forming apparatus, the developer container comprising:

a developer outlet to discharge developer to supply developer to the developing unit;

a first agitator mounted in the developer container to rotate with respect to a first rotational axis in a direction of depth of the developer container; and a second agitator mounted in the developer container to rotate with respect to a second rotational axis parallel to the first rotational axis, wherein the developer outlet is provided at an end region of the developer container in the direction of a depth D of the developer container, wherein the developer outlet is positioned at the end region of the developer container such that the first rotational axis of the first agitator and the second rotational axis of the second agitator extend along opposite sides of the developer container in relation to the developer outlet, wherein the first and second rotational axes extend in the depth direction, and wherein the developer inlets of the developing units vertically face the developer outlets of the respective developer containers.

10. The developer container of claim 9, wherein the first and second rotational axes extends in the depth direction.

11. The developer container of claim 10, wherein the developer outlet is provided at a lower region of the developer container between the first and second agitator.

12. The developer container of claim 10, further comprising an auger to transfer developer in the direction of the depth D of the developer container to the developer outlet.

13. The developer container of claim 11, wherein the first and second agitators transfer the developer in a direction toward the auger.

14. The developer container of claim 9, wherein the first agitator and the second agitator are adapted for rotation in opposite rotational directions with respect to each other to transfer the developer toward the auger.

* * * * *